US007337931B2

(12) United States Patent
Edwards

(10) Patent No.: US 7,337,931 B2
(45) Date of Patent: Mar. 4, 2008

(54) GARMENT STRETCHER

(75) Inventor: Christopher M. Edwards, Dayton, NV (US)

(73) Assignee: Fits Again LLC, Dayton, NV (US)

( * ) Notice: Subject to any disclaimer, the term of this patent is extended or adjusted under 35 U.S.C. 154(b) by 0 days.

(21) Appl. No.: 11/424,977

(22) Filed: Jun. 19, 2006

(65) Prior Publication Data

US 2007/0215654 A1 Sep. 20, 2007

(51) Int. Cl.
*D06C 15/00* (2006.01)

(52) U.S. Cl. ..... 223/61

(58) Field of Classification Search ..... 223/61, 223/63, 52, 69, 95, 85.3, 72, 74, 120; 33/2 R, 33/881, 812, 810; 38/70, 102, 102.1, 102.6, 38/102.8

See application file for complete search history.

(56) References Cited

U.S. PATENT DOCUMENTS

| | | | | |
|---|---|---|---|---|
| 371,038 | A | 10/1887 | Davis | |
| 604,122 | A | 5/1898 | O'Thayne | |
| 784,752 | A | 3/1905 | Nelson | |
| 1,052,426 | A | 2/1913 | Ringler | |
| 1,096,145 | A | 5/1914 | Anderson | |
| 1,581,662 | A * | 4/1926 | Sangers | 38/102.7 |
| 2,119,604 | A * | 6/1938 | Shepherd | 223/69 |
| 2,120,748 | A | 6/1938 | Harris | |
| 2,122,432 | A | 9/1938 | Maschke | |
| 2,195,673 | A * | 4/1940 | Kuehne | 223/69 |
| 2,241,895 | A * | 5/1941 | Walker et al. | 38/102.1 |
| 2,390,004 | A | 11/1945 | Schoepfer et al. | |
| 2,448,574 | A * | 9/1948 | Bothe | 403/259 |
| 2,539,895 | A | 1/1951 | Cuneo et al. | |
| 2,583,996 | A | 1/1952 | Cavanagh | |
| 2,593,722 | A * | 4/1952 | Bothe | 38/102.1 |
| 2,626,091 | A | 1/1953 | Reguitti | |
| 2,746,657 | A | 5/1956 | Feathers | |
| 2,777,618 | A | 1/1957 | Wilklow | |
| 2,887,257 | A | 5/1959 | Itkonen | |
| 2,929,538 | A | 3/1960 | Douglass | |
| 2,958,447 | A | 11/1960 | Rouseau | |
| 3,517,865 | A | 6/1970 | Kannegiesser et al. | |
| 4,364,495 | A * | 12/1982 | Walker | 223/61 |
| 4,830,237 | A | 5/1989 | Louw | |
| 5,557,870 | A * | 9/1996 | Bergman | 40/603 |
| 5,597,099 | A | 1/1997 | Sharp | |
| 6,516,978 | B1 * | 2/2003 | Chapman | 223/69 |

* cited by examiner

*Primary Examiner*—Gary L. Welch
*Assistant Examiner*—Andrew W Sutton
(74) *Attorney, Agent, or Firm*—Sierra Patent Group, Ltd.

(57) ABSTRACT

A garment stretching device comprising: a top T-member defined by a horizontal member and a vertical member, the vertical member having a plurality of notches longitudinally disposed along its surface; a top L-member defined by a horizontal member and a vertical member, the horizontal member and the vertical member each having a plurality of notches longitudinally disposed along their surface; a first bottom member defined by a top horizontal member, a vertical member, and a bottom horizontal member; a second bottom member defined by a top horizontal member, a vertical member, and a bottom horizontal member, the top horizontal member and the bottom horizontal member each having a plurality of notches longitudinally disposed along their surface, wherein the top T-member, the top L-member, the first bottom member, and the second bottom member are configured to adjustably interlock using the pluralities of notches in conjunction with corresponding locking mechanisms.

20 Claims, 8 Drawing Sheets

GARMENT STRETCHER

BACKGROUND

1. Field of the Invention

The present invention relates to a garment stretching device. More particularly, the present invention relates to a garment stretching device for re-sizing clothes through vertical and horizontal stretching.

2. The Prior Art

Prior art garment stretching devices suffer from several deficiencies. These prior art devices have too many parts and are overly complicated, as they are typically directed towards commercial applications, such as for tailors, dressmakers and sweater factories, rather than home use. Furthermore, the prior art designs result in bumps and irregularities in the final exterior shape of the garment due to the protrusions of certain parts, such as wing nuts and the like. Additionally, the prior art devices fail to provide a simple and effective means for visual identification of the setting size of the garment stretching device.

What is needed in the art is a garment stretching device that overcomes the deficiencies of the prior art.

SUMMARY

In an exemplary embodiment, the present invention discloses a garment stretching device comprising: a top T-member defined by a horizontal member and a vertical member substantially perpendicular to the horizontal member, the horizontal member having an adjustment slot formed in its bottom surface, the vertical member having a plurality of notches longitudinally disposed along its surface; a top L-member defined by a horizontal member and a vertical member substantially perpendicular to the horizontal member, the horizontal member and the vertical member each having a plurality of notches longitudinally disposed along their surface; a first bottom member defined by a top horizontal member, a vertical member substantially perpendicular to the top horizontal member, and a bottom horizontal member substantially perpendicular to the vertical member, the top horizontal member of the first bottom member having a first adjustment aperture at one end and a second adjustment aperture aligned with the vertical member, the bottom horizontal member having an adjustment aperture at one end; and a second bottom member defined by a top horizontal member, a vertical member substantially perpendicular to the top horizontal member, and a bottom horizontal member substantially perpendicular to the vertical member, the top horizontal member having a plurality of notches longitudinally disposed along its surface and an adjustment aperture substantially aligned with the vertical member, the bottom horizontal member having a plurality of notches longitudinally disposed along its surface, wherein the plurality of notches on the vertical member of the top T-member are configured to adjustably interlock with a locking mechanism on the vertical member of the first bottom member, the plurality of notches on the horizontal member of the top L-member are configured to adjustably interlock with a locking mechanism on the horizontal member of the top T-member, the plurality of notches on the vertical member of the top L-member are configured to adjustably interlock with a locking mechanism on the vertical member of the second bottom member, the plurality of notches on the top horizontal member of the second bottom member is configured to adjustably interlock with a locking mechanism on the top horizontal member of the first bottom member, and the plurality of notches on the bottom horizontal member of the second bottom member is configured to adjustably interlock with a locking mechanism on the bottom horizontal member of the first bottom member.

DETAILED DESCRIPTION

Figure 1:
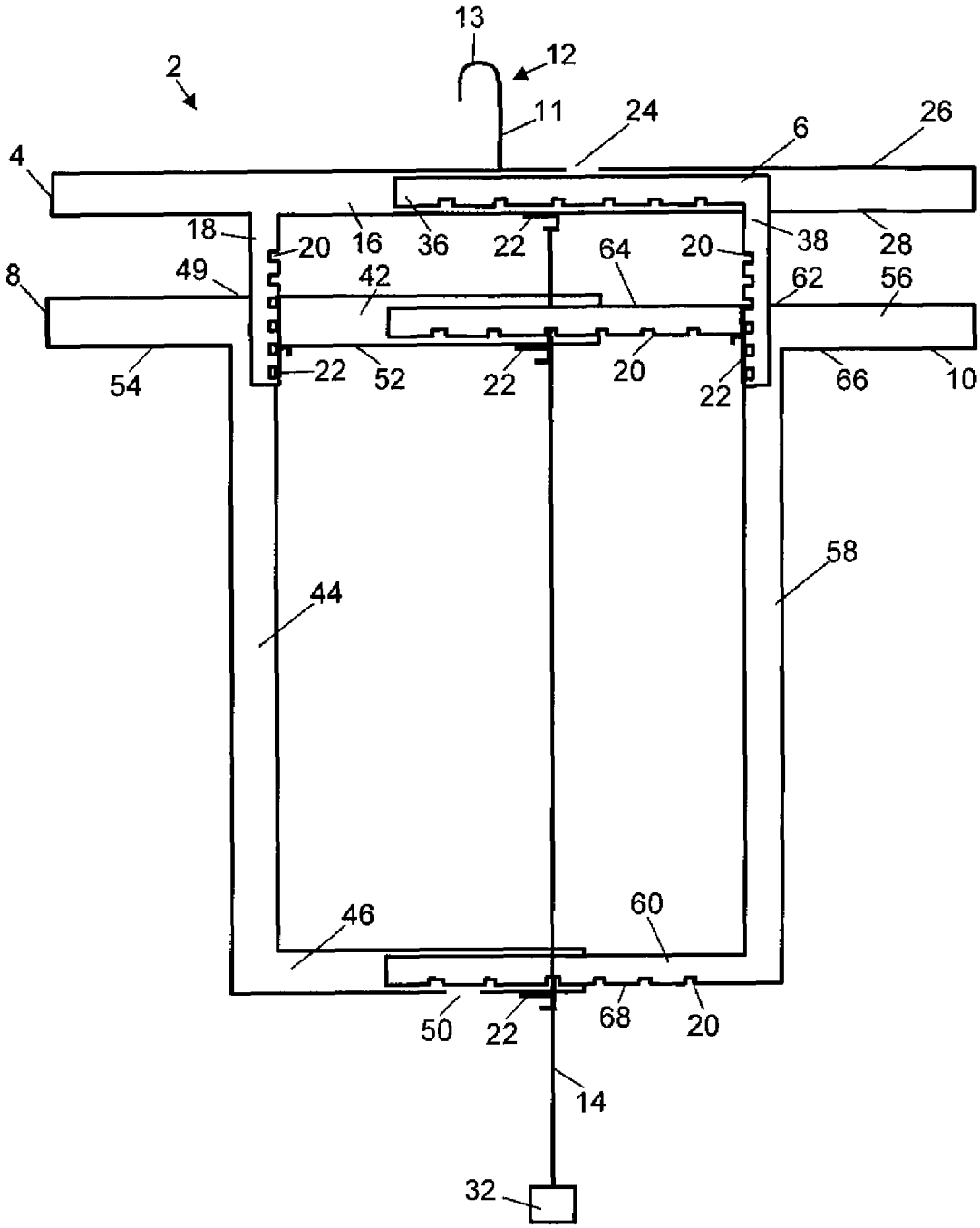
FIG. 1 is a front view of an exemplary embodiment of a garment stretching device according to the present invention.

Persons of ordinary skill in the art will realize that the following disclosure is illustrative only and not in any way limiting. Other embodiments of the invention will readily suggest themselves to such skilled persons having the benefit of this disclosure.

In FIGS. 1 through 7, an exemplary embodiment of a garment stretching device 2 is shown, wherein like elements are numbered alike. Garment stretching device 2 comprises top T-member 4, top L-member 6, first bottom member 8, and second bottom member 10 interconnected in an adjustable configuration.

Top T-member 4 comprises a substantially straight horizontal member 16 connected to a substantially straight vertical member 18. In a preferred embodiment, horizontal member 16 and vertical member 18 are substantially perpendicular to one another, thereby forming a T-shape. Vertical member 18 is preferably connected to horizontal member 16 at a position offset from the center and the ends of horizontal member 16.

Horizontal member 16 has a top surface 26 and a bottom surface 28 opposite top surface 26 defining a hollow interior. Bottom surface 28 comprises adjustment slot 30 for receiving top L-member 6, as can be seen in FIG. 1 and which will be discussed in further detail below. Adjustment slot 30 is an opening that extends along a portion of bottom surface 28, thereby allowing top L-member 6 to be adjusted horizontally along horizontal member 16. In a preferred embodiment shown in FIG. 2B, adjustment slot extends from one end of horizontal member opposite vertical member 18 towards the center of horizontal member 16.

Horizontal member 16 also comprises locking mechanism 22. In a preferred embodiment shown in FIG. 2A, locking member 22 is a flexible lever having a portion that protrudes into the interior of horizontal member 16 when left alone. This protruding portion locks into notch 20 in top L-member 8, thereby securing the horizontal position of top T-member 4 and top L-member 6 with respect to one another. A user can manipulate the lever to release the protruding portion from notch 20, thereby allowing for the horizontal adjustment of top L-member 6 with respect to top T-member 4. It is contemplated that a variety of other locking mechanisms may be employed as well. In a preferred embodiment, locking mechanism 22 is disposed on bottom surface 28 proximate the center of horizontal member 16. However, locking mechanism 22 may be disposed in a variety of different locations on horizontal member 16, including, but not limited to, on upper surface 26 and anywhere from the center to the ends of horizontal member 16.

Horizontal member 16 also comprises size indication aperture 24. Size indication aperture 24 is an opening in horizontal member 16 that allows the user to view the size indicia 40 displayed on top L-member 6, as will be discussed in further detail below. As the user horizontally adjusts top L-member 6 with respect to top T-member 4, the user can see the corresponding size for each notch 20. In a preferred embodiment, size indication aperture 24 is disposed on top surface 26 proximate the center of horizontal member 16. However, size indication aperture 24 may be disposed in a variety of different locations on horizontal member 16, including, but not limited to, bottom surface 28 and anywhere from the center to the ends of horizontal member 16.

Figure 2A:
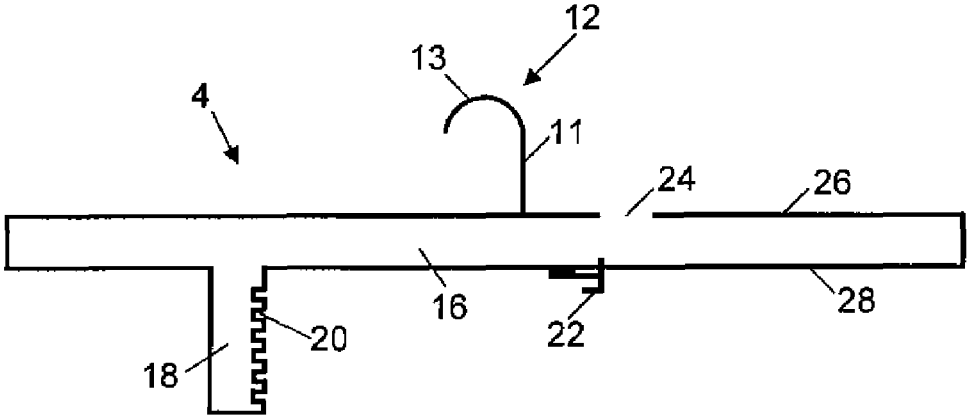
FIG. 2A is a front view of an exemplary embodiment of a top T-member according to the present invention.
Figure 2B:
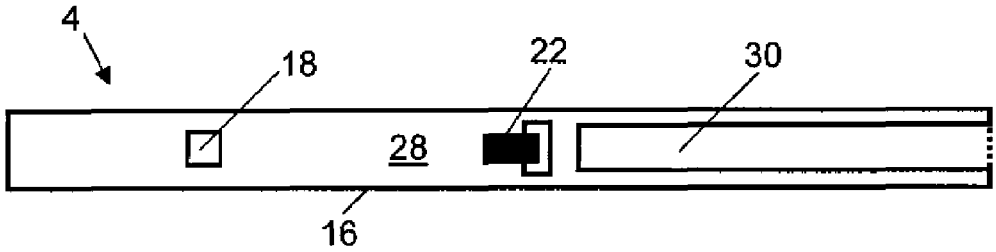
FIG. 2B is a bottom view of an exemplary embodiment of a top T-member according to the present invention.
Figure 2C:
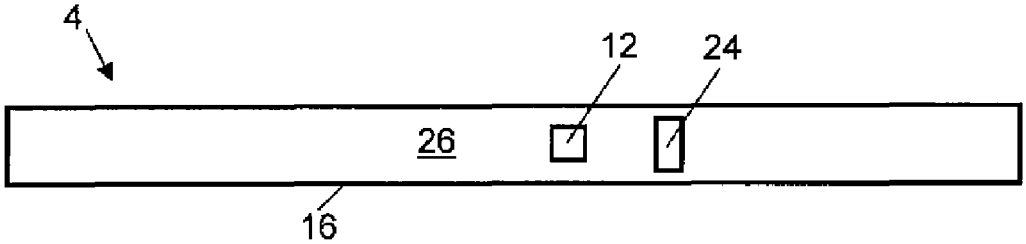
FIG. 2C is a top view of an exemplary embodiment of a top T-member according to the present invention.

Horizontal member 16 may also comprise hanger hook 12. Hanger hook 12 may comprise a shaft 11 extending upward and away from upper surface 26 and terminating in hook end 13. In a preferred embodiment, shaft 11 is rotatably coupled to horizontal member 16, thereby allowing hanger hook 12 to rotate about a vertical axis. Shaft 11 may alternatively be coupled to horizontal member 16 in a fixed position. FIG. 2A shows hanger hook 12 disposed proximate the center of horizontal member 16. However, it is contemplated that hanger hook 12 may be disposed in a variety of different locations along horizontal member 16. Additionally, a plurality of hanger hooks 12 may be employed.

Figure 7:
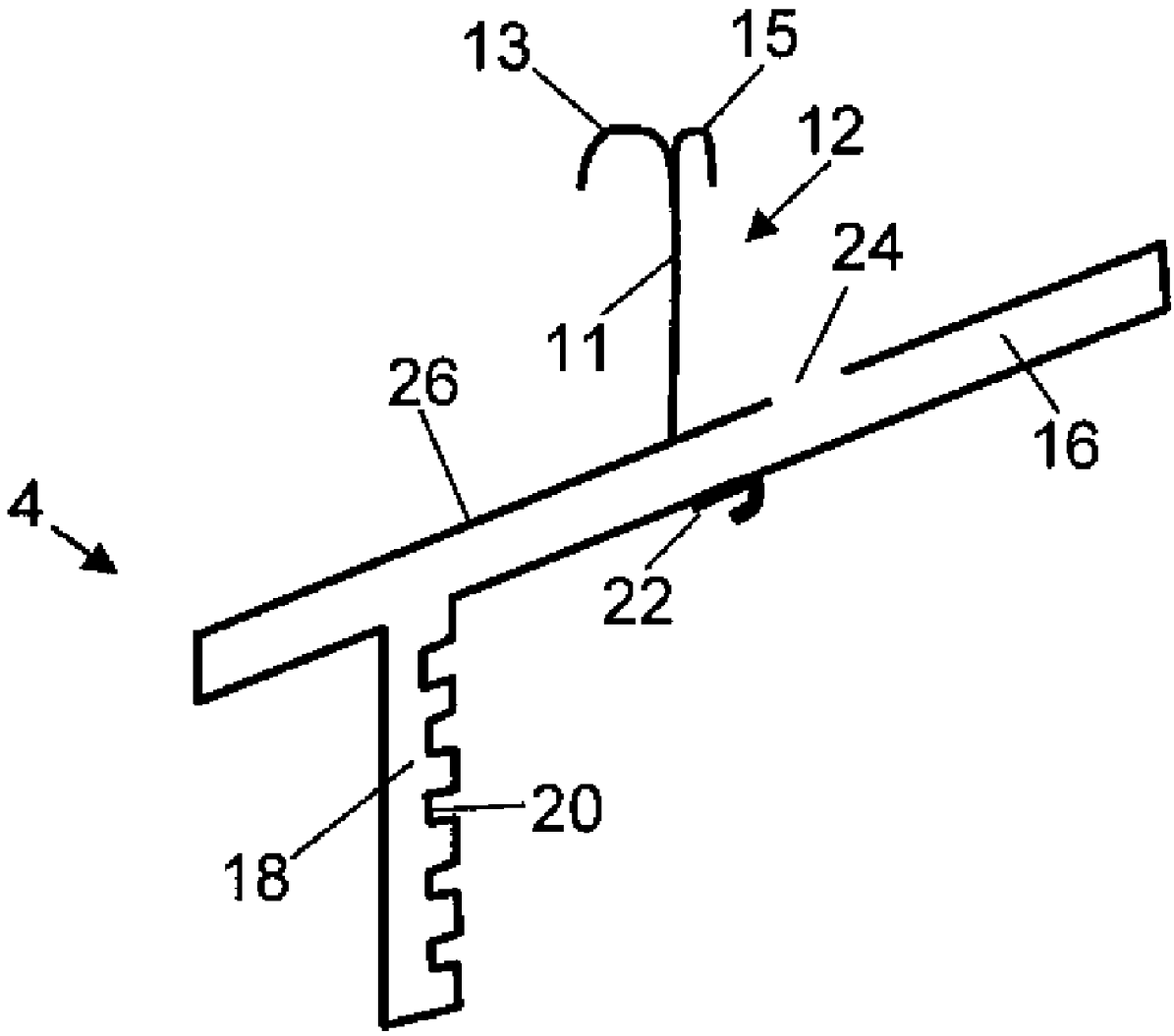
FIG. 7 is a diagonal view of an exemplary embodiment of the top T-member having a hanger hook with a split-hook design according to the present invention.

In an alternative embodiment illustrated in FIG. 7, hanger hook 12 may comprise a split-hook design, wherein shaft 11 extends upward and away from upper surface 26 and terminating in separate hook ends 13 and 15. As mentioned above, shaft 11 may be rotatably coupled to horizontal member 16 or, in the alternative, coupled in a fixed position. In a preferred embodiment, hook ends 13 and 15 are positioned substantially perpendicular to one another, with the plane of hook end 13 being substantially parallel to the lengthwise plane of horizontal member 16 and the plane of hook end 15 being substantially parallel to the lengthwise plane of horizontal member 16. In this configuration, garment stretching device 2 may be hung on a shower head or on a shower curtain rod without placing the garment in an awkward position and exposing it to unwanted contact with external objects.

Figure 2D:
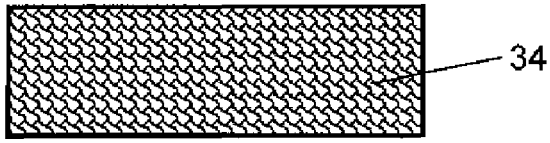
FIG. 2D is an exemplary embodiment of a textured surface according to the present invention.

The outer surface of horizontal member 16 may be textured in order to promote the clinging of clothes to horizontal member 16. This outer surface may include any combination of the top surface 26, bottom surface 28 and side surfaces of horizontal member 16. FIG. 2D illustrated an exemplary embodiment of a textured surface 34. It is contemplated that textured surface 34 may be disposed continuously along the length of horizontal member 16 or may be segmented.

Vertical member 18 extends from bottom surface 28 of horizontal member 16 and comprises a plurality of notches 20. Notches 20 are configured to receive and secure a portion of locking mechanism 22 and preferably have about the same size and shape. Furthermore, each notch 20 may be separated by a substantially uniform distance from its adjacent notches 20. FIG. 2A shows notches 20 disposed on the inside portion of vertical member 18. However, it is contemplated that notches 20 may be positioned anywhere on vertical member 18, so long as the positioning corresponds with the positioning of the locking mechanisms on first bottom member 8.

Figure 3A:
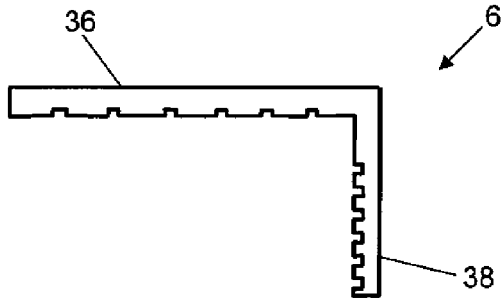
FIG. 3A is a front view of an exemplary embodiment of a top L-member according to the present invention.

Top L-member 6 comprises a substantially straight horizontal member 36 connected to a substantially straight vertical member 38. In a preferred embodiment, horizontal member 36 and vertical member 38 are substantially perpendicular to one another. FIG. 3A shows vertical member 38 connected to one end of horizontal member 36, thereby forming an L-shape. However, it is contemplated that vertical member 38 may also be connected to horizontal member 36 at a position offset from the end of horizontal member 36, thereby forming a shape similar to that of top T-member 4 in FIG. 2A.

Horizontal member 36 may be hollow or may be solid. The outer diameter of horizontal member 36 of top L-member 6 is preferably smaller than the inner diameter of horizontal member 16 of top T-member 4, thereby allowing horizontal member 36 to fit and move inside horizontal member 16. Horizontal member 36 comprises a plurality of notches 20. Notches 20 are configured to receive and secure a portion of locking mechanism 22 on horizontal member 16 on top T-member 4 and preferably have about the same size and shape. Furthermore, each notch 20 may be separated by a substantially uniform distance from its adjacent notches 20. FIG. 3A shows notches 20 disposed on the bottom portion of horizontal member 36. However, it is contemplated that notches 20 may be positioned anywhere on horizontal member 36, so long as the positioning corresponds with the positioning of the locking mechanisms on horizontal member 16.

Figure 3B:
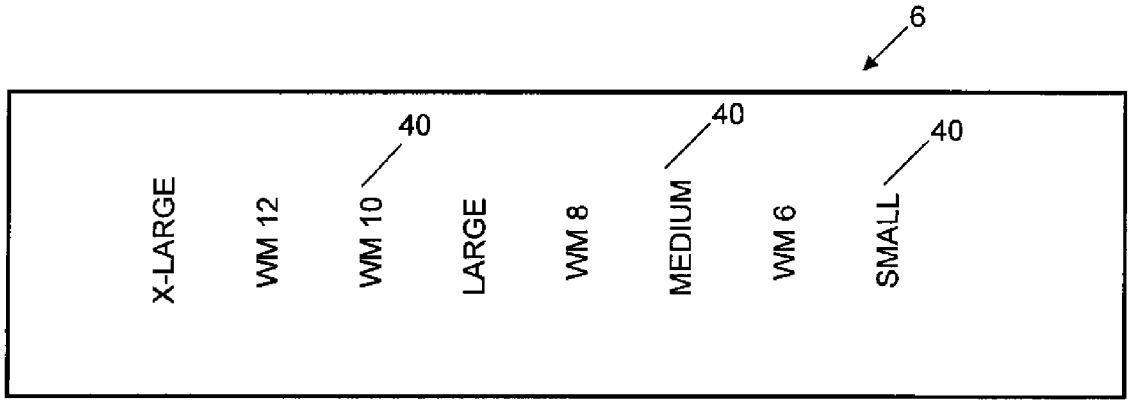
FIG. 3B is a top view of an exemplary embodiment of a top L-member according to the present invention.

As seen in FIG. 3B, horizontal member 36 may comprise a set of size indicia 40. Size indicia 40 correspond to notches 20 on horizontal member 36 and provide an indication of how wide the garment is being stretched horizontally, i.e. the size of the garment. Examples of such size indicia 40 include "X-LARGE," "LARGE," "MEDIUM," AND "SMALL." In a preferred embodiment, size indicia 40 are uniformly spaced apart and disposed on the top surface of horizontal member 36. However, it is contemplated, that size indicia 40 may be disposed in a variety of different locations on horizontal member 36 so long as they correspond with notches 20. Furthermore, size indicia 40 may be applied to horizontal member 36 in a variety of ways including, but not limited to, printing, imprinting, and molding.

Similar to horizontal member 36, vertical member 38 may be hollow or solid. The outer diameter of vertical member 38 of top L-member 6 is preferably smaller than the inner diameter of vertical member 58 of second bottom member 10, thereby allowing vertical member 38 to fit and move inside vertical member 58. Vertical member 38 comprises a plurality of notches 20. Notches 20 are configured to receive and secure a portion of a locking mechanism on vertical member 58 and preferably have about the same size and shape. Furthermore, each notch 20 may be separated by a substantially uniform distance from its adjacent notches 20. FIG. 3A shows notches 20 disposed on the inner portion of vertical member 38. However, it is contemplated that notches 20 may be positioned anywhere on vertical member 38, so long as the positioning corresponds with the positioning of the locking mechanisms on vertical member 58.

Figure 4:
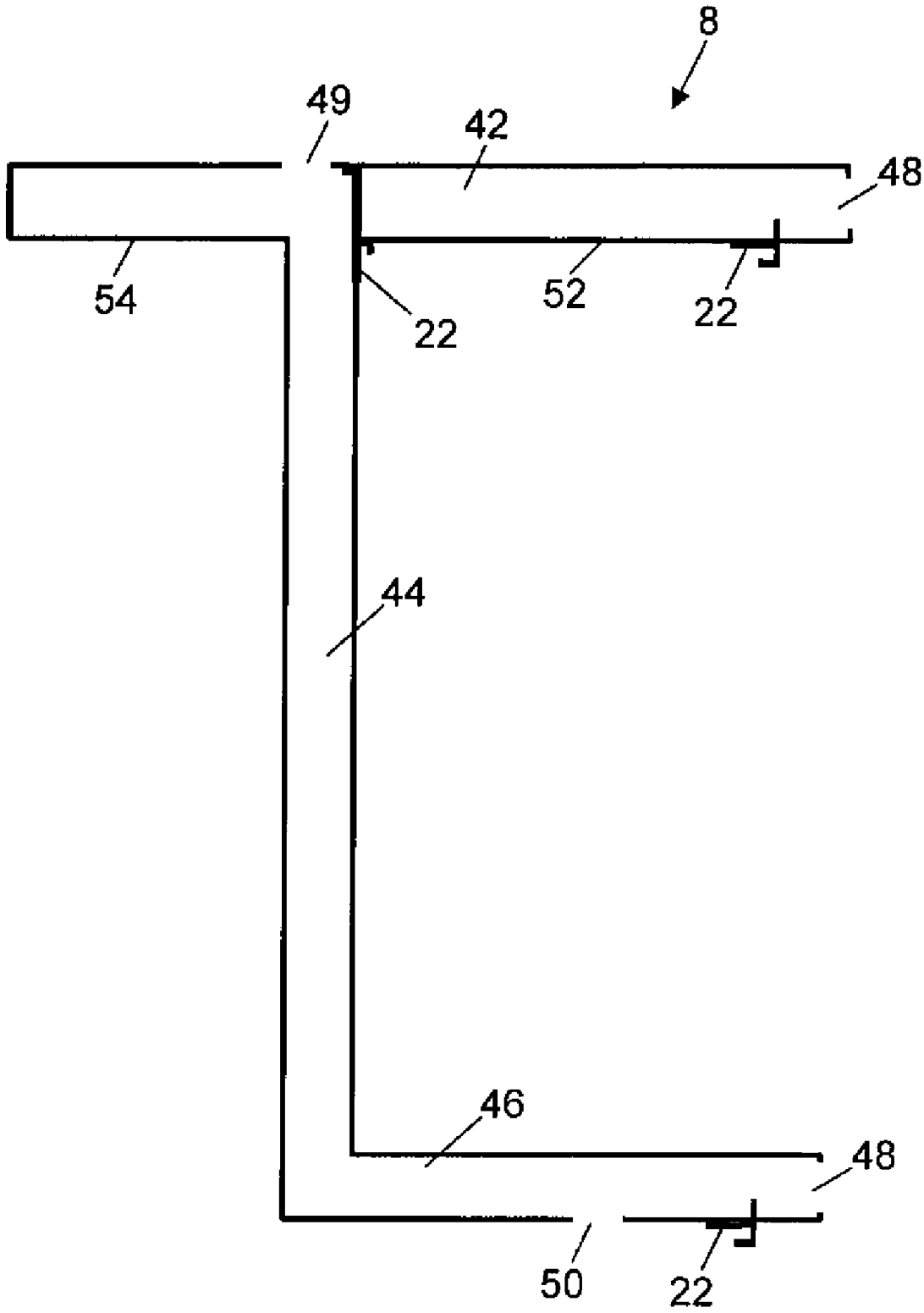
FIG. 4 is a front view of an exemplary embodiment of a first bottom member according to the present invention.

First bottom member 8 comprises a substantially straight top horizontal member 42 connected to a substantially straight vertical member 44, and a substantially straight bottom horizontal member 46 connected to vertical member 44. Top horizontal member 42, vertical member 44 and bottom horizontal member 46 all comprise a hollow interior. In a preferred embodiment, top horizontal member 42 and bottom horizontal member 46 are substantially perpendicular to vertical member 44. FIG. 4 shows vertical member 44 connected to top horizontal member 42 at a position offset from the ends of top horizontal member 42, thereby forming a T-shape. FIG. 4 also shows vertical member 44 connected to bottom horizontal member 46 at one end of bottom horizontal member 46, thereby forming an L-shape.

Top horizontal member 42 comprises inside portion 52 and outside portion 54, each on opposite sides of vertical member 44. Adjustment aperture 48 is disposed at the end of inside portion 52 distal from vertical member 44. Adjustment aperture 48 is an opening configured to receive the inside portion 64 of top horizontal member 56 on second bottom member 10. In a preferred embodiment, the inner diameter of adjustment aperture 48 and inside portion 52 is greater than the outer diameter of inside portion 64 on second bottom member 10.

Inside portion 52 of first bottom member 8 also comprises locking mechanism 22. In a preferred embodiment shown in FIG. 4, locking member 22 is a flexible lever having a portion that protrudes into the interior of horizontal member 16 when left alone. This protruding portion locks into notch 20 in the inside portion 64 of top horizontal member 56 on second bottom member 10, thereby securing the horizontal position of first bottom member 8 and second bottom member 10 with respect to one another. A user can manipulate the lever to release the protruding portion from notch 20, thereby allowing for the horizontal adjustment of first bottom member 8 with respect to second bottom member 10. It is contemplated that a variety of other locking mechanisms may be employed as well. In a preferred embodiment, locking mechanism 22 is disposed on the bottom portion of inside portion 52. However, it is contemplated that locking mechanism 22 may be disposed in a variety of different locations on inside portion 52, so long as its positioning corresponds with the positioning of notches 20 on inside portion 64 of second bottom member 10.

Another adjustment aperture 49 is disposed on the upper portion of top horizontal member 42 where vertical member 44 connects to top horizontal member 42. Adjustment aperture 49 is an opening configured to receive vertical member 18 of top T-member 4. In a preferred embodiment, the inner diameter of adjustment aperture 49 and vertical member 44 is greater than the outer diameter of vertical member 18 on top T-member 4. In this configuration, vertical member 18 of top T-member 4 may fit and move inside adjustment aperture 49 and vertical member 44, thereby allowing for the vertical adjustment of first bottom member 8 with respect to top T-member 4. Vertical member 44 may comprise a locking mechanism 22, such as the flexible lever discussed above, corresponding to the configuration of notches 20 on vertical member 18 of top T-member 4, thereby allowing the user to secure the vertical positioning of top T-member 4 with respect to first bottom member 8.

Bottom horizontal member 46 comprises adjustment aperture 48 disposed at the end of bottom horizontal member 46 distal from vertical member 44. Adjustment aperture 48 is an opening configured to receive bottom horizontal member 60 on second bottom member 10. In a preferred embodiment, the inner diameter of this adjustment aperture 48 and bottom horizontal member 46 is greater than the outer diameter of bottom horizontal member 60 on second bottom member 10.

Bottom horizontal member 46 also comprises locking mechanism 22. Locking mechanism 22 may be a flexible lever, as discussed above. A user can manipulate the lever to release the protruding portion from notch 20 on bottom horizontal member 60 of second bottom member 10, thereby allowing for the horizontal adjustment of first bottom member 8 with respect to second bottom member 10. It is contemplated that a variety of other locking mechanisms may be employed as well. In a preferred embodiment, locking mechanism 22 is disposed on the bottom portion of bottom horizontal member 46. However, it is contemplated that locking mechanism 22 may be disposed in a variety of different locations on bottom horizontal member 46, so long as its positioning corresponds with the positioning of notches 20 on bottom horizontal member 60 of second bottom member 10.

Bottom horizontal member 46 may also comprise size indication aperture 50. Similar to size indication aperture 24, size indication aperture 50 is an opening in bottom horizontal member 46 that allows the user to view the size indicia 40 displayed on bottom horizontal member 60, as will be discussed in further detail below. As the user horizontally adjusts first bottom member 8 with respect to second bottom member 10, the user can see the corresponding size for each notch 20. In a preferred embodiment, size indication aperture 50 is disposed on the bottom portion of bottom horizontal member 46. However, size indication aperture 50 may be disposed in a variety of different locations on bottom horizontal member 46, so long as its positioning corresponds with the positioning of size indicia 68 on bottom horizontal member 60 of second bottom member 10.

Additionally, the outer surface of top horizontal member 42 and vertical member 44 may be textured in order to promote the clinging of clothes to these members of first bottom member 8. This textured surface may be disposed continuously or may be segmented along the length of top horizontal member 42 and vertical member 44. Furthermore, this textured surface may be disposed on the upper portion of top horizontal member 42 and the outside portion of vertical member 44 (i.e. on the same side of vertical member 44 as outside portion 54). However, it is contemplated that the textured surface may be disposed in a variety of ways.

Figure 5:
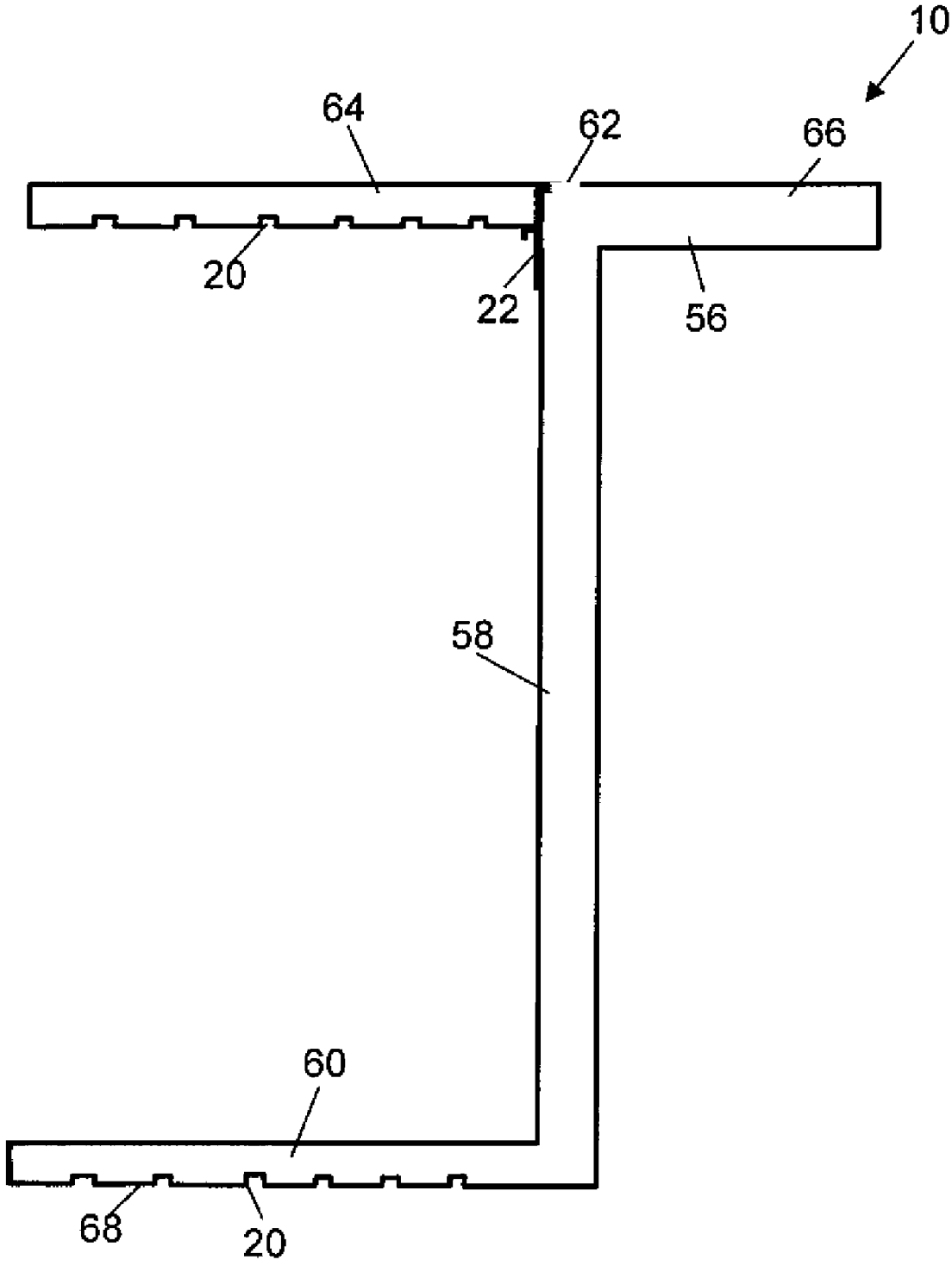
FIG. 5 is a front view of an exemplary embodiment of a second bottom member according to the present invention.

Second bottom member 10 comprises a substantially straight top horizontal member 56 connected to a substantially straight vertical member 58, and a substantially straight bottom horizontal member 60 connected to vertical member 58. Vertical member 58 comprises a hollow interior. In a preferred embodiment, top horizontal member 56 and bottom horizontal member 60 are substantially perpendicular to vertical member 58. FIG. 5 shows vertical member 58 connected to top horizontal member 56 at a position offset from the ends of top horizontal member 56, thereby forming a T-shape. FIG. 5 also shows vertical member 58 connected to bottom horizontal member 60 at one end of bottom horizontal member 60, thereby forming an L-shape.

Top horizontal member 56 comprises inside portion 64 and outside portion 66, each on opposite sides of vertical member 58. In a preferred embodiment, the outer diameter of inside portion 64 is smaller than the inner diameter of adjustment aperture 48 and inside portion 52 on first bottom member 8.

Inside portion 64 of second bottom member 10 also comprises a plurality of notches 20 corresponding to locking mechanism 22 on top horizontal member 42 of first bottom member 8. FIG. 5 shows notches 20 disposed on the bottom portion of inside portion 64. However, it is contemplated that notches 20 may be disposed in a variety of different locations.

Adjustment aperture 62 is disposed on the upper portion of top horizontal member 56 where vertical member 58 connects to top horizontal member 56. Adjustment aperture 62 is an opening configured to receive vertical member 38 of top L-member 6. In a preferred embodiment, the inner diameter of adjustment aperture 62 and vertical member 58 is greater than the outer diameter of vertical member 38 on top L-member 6. In this configuration, vertical member 38 of top L-member 6 may fit and move inside adjustment aperture 62 and vertical member 58, thereby allowing for the vertical adjustment of second bottom member 10 with respect to top L-member 6. Vertical member 58 may comprise a locking mechanism 22, such as the flexible lever discussed above, corresponding to the configuration of notches 20 on vertical member 38 of top L-member 6, thereby allowing the user to secure the vertical positioning of top L-member 6 with respect to second bottom member 10.

Bottom horizontal member 60 comprises a plurality of notches 20 corresponding to locking mechanism 22 on bottom horizontal member 46 of first bottom member 8. FIG. 5 shows notches 20 disposed on the bottom portion of bottom horizontal member 60. However, it is contemplated that notches 20 may be disposed in a variety of different locations.

Similar to size indicia 40 disposed on top L-member 6, size indicia 68 may be disposed in the spaces in between notches 20 on bottom horizontal member 60. In a preferred embodiment, size indicia 40 are disposed on the bottom portion of bottom horizontal member 60. However, it is contemplated that size indicia 68 may be disposed in a variety of locations, so long as it may be viewed through corresponding size indication aperture 50 on bottom horizontal member 46 of first bottom member 8.

Additionally, the outer surface of top horizontal member 56 and vertical member 58 may be textured in order to promote the clinging of clothes to these members of second bottom member 10. This textured surface may be disposed continuously or may be segmented along the length of top horizontal member 56 and vertical member 58. Furthermore, this textured surface may be disposed on the upper portion of top horizontal member 56 and the outside portion of vertical member 58 (i.e. on the same side of vertical member 58 as outside portion 66). However, it is contemplated that the textured surface may be disposed in a variety of ways.

Figure 6A:
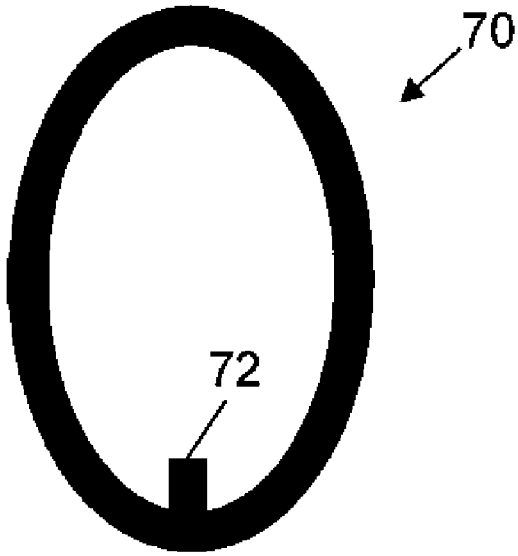
FIG. 6A is a cross-sectional view of an exemplary embodiment of an outer tubular member according to the present invention.
Figure 6B:
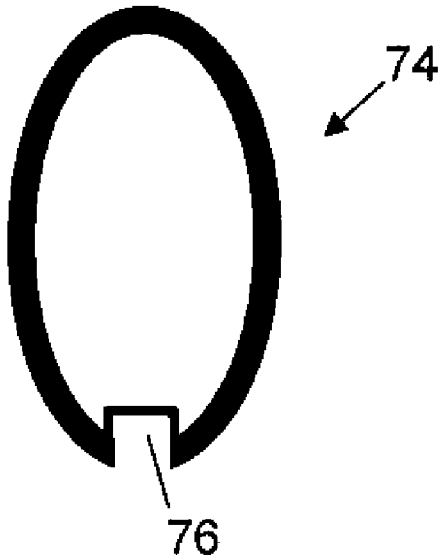
FIG. 6B is a cross-sectional view of an exemplary embodiment of an inner tubular member according to the present invention.

In a preferred embodiment, top T-member 4, top L-member 6, first bottom member 8, and second bottom member 10 comprise a substantially tubular egg-shape, as seen in FIGS. 6A and 6B.

FIG. 6A illustrates an exemplary embodiment of an outer tubular member 70, applying to the portions of these members configured to receive other members. Examples of outer tubular members 70 include horizontal member 16, inside portion 52, vertical member 44, bottom horizontal member 46, and vertical member 58. As seen in FIG. 6A, outer tubular member 70 may comprise protrusion 72 extending longitudinally along outer tubular member 70 and into the interior of outer tubular member 70.

FIG. 6B illustrates an exemplary embodiment of an inner tubular member 74, applying to the portions of top T-member 4, top L-member 6, first bottom member 8, and second bottom member 10 configured to enter the appropriate outer tubular members 70. Examples of inner tubular members 74 include vertical member 18, horizontal member 36, vertical member 38, inside portion 64, and bottom horizontal member 60. As seen in FIG. 6B, inner tubular member 74 may comprise notch 76 extending longitudinally along inner tubular member 74 and into the interior of inner tubular member 74. In a preferred embodiment, notch 76 has a corresponding shape as protrusion 72 and is slightly larger than protrusion 72. In this configuration, protrusion 72 and notch 76 may interlock and prevent outer tubular member 70 and inner tubular member 74 from rotating with respect to one another.

Garment stretching device 2 may also comprise release cord 14 secured to any combination of locking mechanisms 22. Release cord 14 may be tied in a knot, or otherwise coupled to locking mechanisms 22. In this configuration, a user may release or unlock locking mechanisms 22, thereby allowing garment stretching device 2 to collapse and release the tension on the garment. Pull tab 32 may be provided at the end of release cord 14 in order to make it easier for the user to pull release cord 14.

Garment stretching device 2 operates to stretch, and thereby resize, shrunken clothes. Top T-member 4, top L-member 6, first bottom member 8, and second bottom member 10 are assembled, as shown in FIG. 1. Vertical member 18 of top T-member 4 interlocks with vertical member 44 of first bottom member 8, horizontal member 36 of top L-member 6 interlocks with horizontal member 16 of top T-member 4, vertical member 38 of top L-member 6 interlocks with vertical member 58 of second bottom member 10, inside portion 64 of second bottom member 10 interlocks with top horizontal member 42 of first bottom member 8, and bottom horizontal member 60 of second bottom member 10 interlocks with bottom horizontal member 46 of first bottom member 8. Initially, these components are preferably assembled at a small setting in order to make it easier for a garment to be placed over garment stretching device 2. As the garment is placed on garment stretching device 2, hanger hook 12 extends through the neck of the garment. Additionally, the outside portion of horizontal member 16 and top horizontal member 42 extend towards, and possibly into, one arm sleeve of the garment, while the other outside portion of horizontal member 16 and the outside portion of top horizontal member 56 extend towards, and possibly into the other arm sleeve of the garment. Using locking mechanisms 22, garment stretching device 2 may be adjusted to a larger size. It is also contemplated that garment stretching device 2 may be assembled at this desired sized before the garment is placed over it.

Garment stretching device 2 may be hung on a showerhead, shower curtain rod, or a similar support structure using hanger hook 12 as the garment is being stretched. Once the user is satisfied that the garment has been adequately stretched, locking mechanisms 22 may be disengaged or unlocked, allowing garment stretching device 2 to be made smaller and the garment to be easily removed. As mentioned above, the user may simply pull down on release cord 14 in order to disengage locking mechanism 22 from notches 20.

In a preferred embodiment, the frame of garment stretching device 2 is defined by only four adjustable interlocking members. This frame consists of top T-member 4, top L-member 6, first bottom member 8, and second bottom member 10. Notches 20, locking mechanisms 22, and hanger hook 12 are considered to be part of their respective members. However, in the alternative, it is contemplated that additional components may be added as well.

Figure 8:
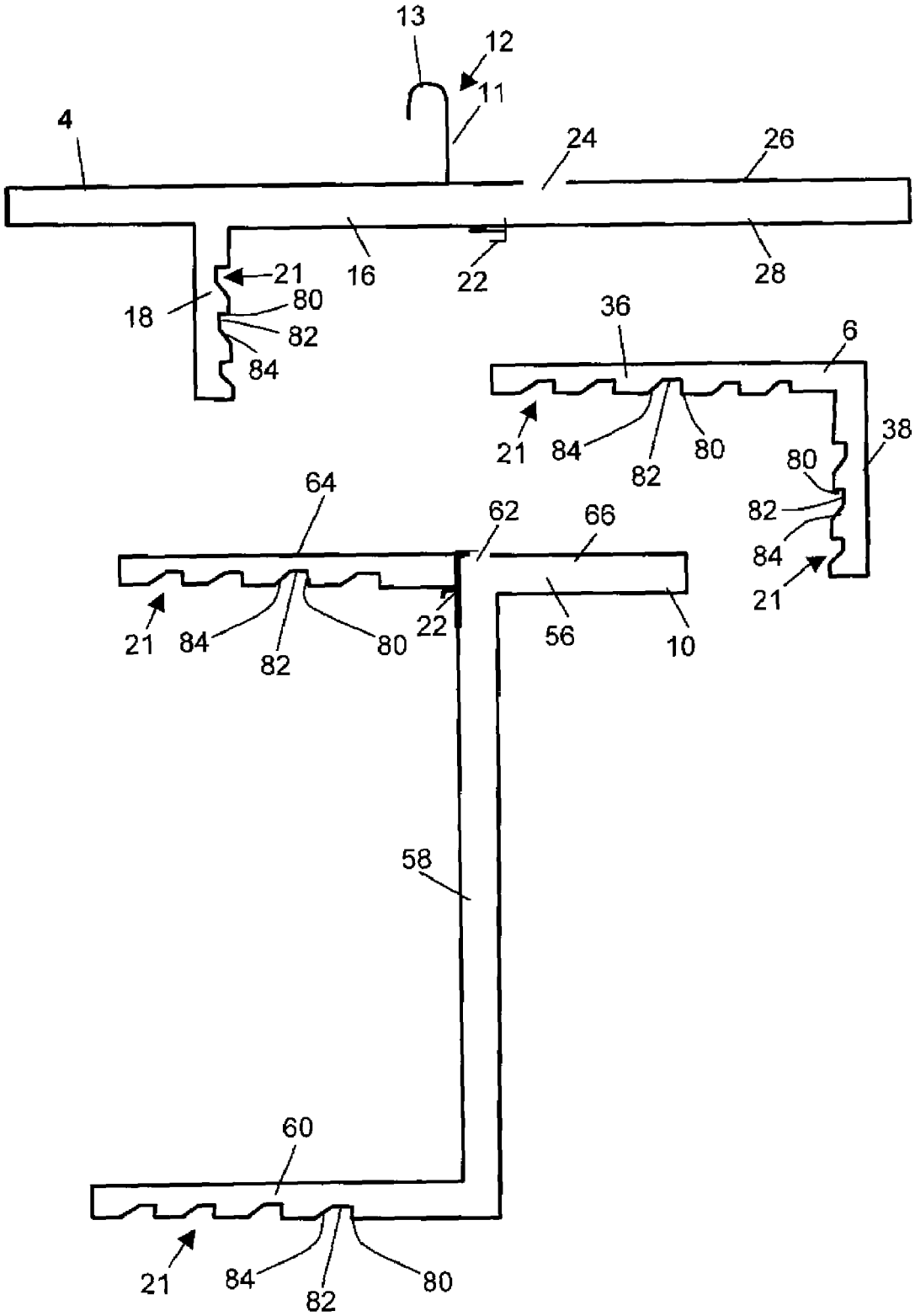
FIG. 8 is an exploded front view of an exemplary embodiment of a top T-member, top L-member, and a second bottom member having angled notches according to the present invention.

Although FIGS. 1-3A, 5 and 7 show notches 20 as being substantially rectangular in shape, it is contemplated that the notches may comprise a variety of other shapes. For example, FIG. 8 illustrates an exemplary embodiment of top T-member 4, top L-member 6, and second bottom member 10 each having angled notches 21. Each angled notch 21 may comprise straight side 80 extending to middle side 82, which extends to angled side 84.

Straight side 80 runs substantially perpendicular to its associated horizontal or vertical member. On top T-member 4, straight side 80 runs substantially perpendicular to vertical member 18. On top L-member 6, straight side 80 on horizontal member 36 runs substantially perpendicular to horizontal member 36, while straight side 80 on vertical member 38 runs substantially perpendicular to vertical member 38. On second bottom member 10, straight side 80 on top horizontal member 56 runs substantially perpendicular to top horizontal member 56, while straight side 80 on bottom horizontal member 60 runs substantially perpendicular to bottom horizontal member 60.

Middle side 82 runs substantially parallel to its associated horizontal or vertical member. On top T-member 4, middle side 82 runs substantially parallel to vertical member 18. On top L-member 6, middle side 82 on horizontal member 36 runs substantially parallel to horizontal member 36, while middle side 82 on vertical member 38 runs substantially parallel to vertical member 38. On second bottom member 10, middle side 82 on top horizontal member 56 runs substantially parallel to top horizontal member 56, while middle side 82 on bottom horizontal member 60 runs substantially parallel to bottom horizontal member 60.

Angled side 84 runs neither substantially parallel nor substantially perpendicular to either of its associated horizontal or vertical members. On top T-member 4, top L-member 6, and second bottom member 10, angled side 84 extends from middle side 82 at an angle directed away from straight side 80. This angled notch configuration allows the user to expand the garment stretching device without having to disengage locking mechanisms 22. The user does not have to pull release cord 14. The user simply pulls the appropriate members away from each other and the corresponding locking mechanisms 22 easily slide over angled side 84 and into the next angled notch 21. On the other hand, the substantially perpendicular configuration of straight side 80 prevents the garment stretching mechanism from being contracted without the user disengaging the corresponding locking mechanisms 22.

Top T-member 4, top L-member 6, first bottom member 8, and second bottom member 10 may be formed from a variety of different materials, including, but not limited to, plastic and aluminum. The other components of garment stretching device 2 may be formed from a variety of materials as well. For example, hanger hook 12 may be formed from plastic, aluminum, steel, or any other suitable material known in the art.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention.

What is claimed is:

1. A garment stretching device comprising:

a top T-member defined by a substantially straight horizontal member and a substantially straight vertical member substantially perpendicular to said horizontal member, said horizontal member having an adjustment slot formed in its bottom surface, said vertical member having a plurality of notches longitudinally disposed along its surface;

a top L-member defined by a substantially straight horizontal member and a substantially straight vertical member substantially perpendicular to said horizontal member, said horizontal member and said vertical member each having a plurality of notches longitudinally disposed along their surface;

a first bottom member defined by a substantially straight top horizontal member, a substantially straight vertical member substantially perpendicular to said top horizontal member, and a substantially straight bottom horizontal member substantially perpendicular to said vertical member, said top horizontal member of said first bottom member having a first adjustment aperture at one end and a second adjustment aperture aligned with said vertical member, said bottom horizontal member having an adjustment aperture at one end; and a second bottom member defined by a substantially straight top horizontal member, a substantially straight vertical member substantially perpendicular to said top horizontal member, and a substantially straight bottom horizontal member substantially perpendicular to said vertical member, said top horizontal member having a plurality of notches longitudinally disposed along its surface and an adjustment aperture substantially aligned with said vertical member, said bottom horizontal member having a plurality of notches longitudinally disposed along its surface, wherein said plurality of notches on said vertical member of said top T-member are configured to adjustably interlock with a locking mechanism on said vertical member of said first bottom member, said plurality of notches on said horizontal member of said top L-member are configured to adjustably interlock with a locking mechanism on said horizontal member of said top T-member, said plurality of notches on said vertical member of said top L-member are configured to adjustably interlock with a locking mechanism on said vertical member of said second bottom member, said plurality of notches on said top horizontal member of said second bottom member is configured to adjustably interlock with a locking mechanism on said top horizontal member of said first bottom member, and said plurality of notches on said bottom horizontal member of said second bottom member is configured to adjustably interlock with a locking mechanism on said bottom horizontal member of said first bottom member, thereby allowing for the positioning of said top T-member, said top L-member, said first bottom member, and said second bottom member with respect to one another to be maintained.

2. The garment stretching device of claim 1, wherein:

said horizontal member of said top T-member comprises a first end, a center, and a second end opposite said first end, said adjustment slot formed in the bottom surface of said horizontal member of said top T-member between said center and said second end, said vertical member of said top T-member connected to said horizontal member of said top T-member at a position in between said first end and said center;

said horizontal member of said top L-member comprises a first end and a second end opposite said first end, said plurality of notches on said horizontal member of said top L-member being longitudinally disposed along its surface between said first end and said second end, and said vertical member of said top L-member connected to said first end of said horizontal member of said top L-member;

said top horizontal member of said first bottom member having a first end and a second end opposite said first end, said vertical member of said first bottom member having a first end and a second end opposite said first end, said first end of said vertical member connected to said top horizontal member at a position in between said first end and said second end of said top horizontal member, said first adjustment aperture of said top horizontal member being disposed at said second end, said bottom horizontal member having a first end connected to said second end of said vertical member of said first bottom member and a second end opposite said first end of said bottom horizontal member, said adjustment aperture of said bottom horizontal member disposed at said second end of said bottom horizontal member; and said top horizontal member of said second bottom member having a first end and a second end opposite said first end, said vertical member of said second bottom member having a first end and a second end opposite said first end, said first end of said vertical member connected to said top horizontal member at a position in between said first end and said second end of said top horizontal member, said plurality of notches on said top horizontal member being longitudinally disposed between said second end of said top horizontal member and said vertical member, said bottom horizontal member having a first end connected to said second end of said vertical member and a second end opposite said first end of said bottom horizontal member, said plurality of notches on said bottom horizontal member being longitudinally disposed between said second end of said bottom horizontal member and said vertical member.

3. The garment stretching device of claim 2, wherein:

said horizontal member of said top T-member further comprises a hollow interior in communication with said adjustment slot, said hollow interior and said adjustment slot configured to receive said horizontal member of said top L-member and allow for the horizontal adjustment of said horizontal member of said top L-member inside said horizontal member of said top T-member;

said top horizontal member of said first bottom member further comprising a hollow interior in communication with said first adjustment aperture of said top horizontal member of said first bottom member, said hollow interior and said first adjustment aperture configured to receive said top horizontal member of said second bottom member and allow for the horizontal adjustment of said top horizontal member of said second bottom member inside said top horizontal member of said first bottom member;

said vertical member of said first bottom member further comprising a hollow interior in communication with said second adjustment aperture of said top horizontal member of said first bottom member, said hollow interior and said second adjustment aperture configured to receive said vertical member of said top T-member and allow for the vertical adjustment of said vertical member of said top T-member inside said vertical member of said first bottom member;

said bottom horizontal member of said first bottom member further comprising a hollow interior in communication with said adjustment aperture of said bottom horizontal member of said first bottom member, said hollow interior and said adjustment aperture configured to receive said bottom horizontal member of said second bottom member and allow for the horizontal adjustment of said bottom horizontal member of said second horizontal member inside said bottom horizontal member of said first bottom member; and said vertical member of said second bottom member further comprising a hollow interior in communication with said adjustment aperture of said top horizontal member of said second bottom member, said hollow interior and said adjustment aperture configured to receive said vertical member of said top L-member and allow for the vertical adjustment of said vertical member of said top L-member inside said vertical member of said second bottom member.

4. The garment stretching device of claim 3, wherein said top T-member further comprises a hanger hook disposed at about the center of said horizontal member of said top T-member, said hanger hook comprising a shaft extending away from the surface of said horizontal member of said top T-member and terminating in a hook end.

5. The garment stretching device of claim 3, wherein said top T-member further comprises a hanger hook disposed at about the center of said horizontal member of said top T-member, said hanger hook comprises a shaft extending away from the surface of said horizontal member of said top T-member and terminating in two separate hook ends, said separate hook ends being disposed substantially perpendicular to one another.

6. The garment stretching device of claim 3, wherein said horizontal member of said top L-member further comprises a set of size indicium displayed on its outer surface, said set of size indicium corresponding to said plurality of notches on said horizontal member of said top L-member.

7. The garment stretching device of claim 6, wherein said horizontal member of said top T-member further comprises a size indication aperture, said size indication aperture defined by an opening configured to allow a user to view one of said set of size indicium when said horizontal member of said top L-member is disposed within said hollow interior of said horizontal member of said top T-member, said one of said set of size indicium corresponding to whichever notch of said horizontal member of said top L-member is being engaged by said locking mechanism on said horizontal member of said top T-member.

8. The garment stretching device of claim 6, wherein said set of size indicium on said horizontal member of said top L-member comprises imprinted text.

9. The garment stretching device of claim 3, wherein said bottom horizontal member of said second bottom member further comprises a set of size indicium displayed on its outer surface, said set of size indicium corresponding to said plurality of notches on said horizontal member of said second bottom member.

10. The garment stretching device of claim 9, wherein said bottom horizontal member of said first bottom member further comprises a size indication aperture, said size indication aperture defined by an opening configured to allow a user to view one of said set of size indicium on said bottom horizontal member of said second bottom member when said bottom horizontal member of said second bottom member is disposed within said hollow interior of said bottom horizontal member of said first bottom member, said one of said set of size indicium corresponding to whichever notch of said bottom horizontal member of said second bottom member is being engaged by said locking mechanism on said bottom horizontal member of said first bottom member.

11. The garment stretching device of claim 9, wherein said set of size indicium on said bottom horizontal member of said second bottom member comprises imprinted text.

12. The garment stretching device of claim 3, wherein said horizontal member and said vertical member of said top T-member, said horizontal member and said vertical member of said top L-member, said top horizontal member, said vertical member, and said bottom horizontal member of said first bottom member, said top horizontal member, said vertical member, and said bottom horizontal member of said second bottom member all comprise a substantially tubular shape.

13. The garment stretching device of claim 12, wherein:

said horizontal member of said top T-member comprises a protrusion longitudinally disposed along its surface and extending towards its interior, said horizontal member of said top L-member comprising a guide notch longitudinally disposed along its surface and having a size and shape that corresponds with said protrusion on said horizontal member of said top T-member, thereby allowing said protrusion on said top T-member to run within said guide notch on said top L-member and prevent said top T-member and said top L-member from rotating with respect to one another;

said top horizontal member of said first bottom member comprises a protrusion longitudinally disposed along its surface and extending towards its interior, said top horizontal member of said second bottom member comprising a guide notch longitudinally disposed along its surface and having a size and shape that corresponds with said protrusion on said top horizontal member of said first bottom member, thereby allowing said protrusion on said first bottom member to run within said guide notch on said second bottom member and prevent said first bottom member and said second bottom member from rotating with respect to one another;

said bottom horizontal member of said first bottom member comprises a protrusion longitudinally disposed along its surface and extending towards its interior, said bottom horizontal member of said second bottom member comprising a guide notch longitudinally disposed along its surface and having a size and shape that corresponds with said protrusion on said bottom horizontal member of said first bottom member, thereby allowing said protrusion on said first bottom member to run within said guide notch on said second bottom member and prevent said first bottom member and said second bottom member from rotating with respect to one another;

said vertical member of said first bottom member comprises a protrusion longitudinally disposed along its surface and extending towards its interior, said vertical member of said top T-member comprising a guide notch longitudinally disposed along its surface and having a size and shape that corresponds with said protrusion on said vertical member of said first bottom member, thereby allowing said protrusion on said first bottom member to run within said guide notch on said vertical member of said top T-member and prevent said first bottom member and said top T-member from rotating with respect to one another; and said vertical member of said second bottom member comprises a protrusion longitudinally disposed along its surface and extending towards its interior, said vertical member of said top L-member comprising a guide notch longitudinally disposed along its surface and having a size and shape that corresponds with said protrusion on said vertical member of said second bottom member, thereby allowing said protrusion on said second bottom member to run within said guide notch on said vertical member of said top L-member and prevent said second bottom member and said top L-member from rotating with respect to one another.

14. The garment stretching device of claim 3, wherein said locking mechanisms on said vertical member of said first bottom member, said horizontal member of said top T-member, said vertical member of said second bottom member, said top horizontal member of said first bottom member, and said bottom horizontal member of said first bottom member each comprise a flexible lever having a portion that protrudes into their respective member interiors, said portion being configured to interlock with corresponding notches on said vertical member of said top T-member, said horizontal member of said top L-member, said vertical member of said top L-member, said top horizontal member of said second bottom member, and said bottom horizontal member of said second bottom member.

15. The garment stretching device of claim 2, wherein said adjustment slot extends from said second end of said horizontal member of said top T-member towards said center of said horizontal member of said top T-member.

16. The garment stretching device of claim 2, wherein all of said pluralities of notches are uniform in size and shape.

17. The garment stretching device of claim 2, wherein all of said pluralities of notches comprise an angled configuration allowing a user to expand said garment stretching device without manually disengaging a corresponding said locking mechanism.

18. The garment stretching device of claim 1, further comprising a release cord attached to said locking mechanisms on said vertical member of said first bottom member, said horizontal member of said top T-member, said vertical member of said second bottom member, said top horizontal member of said first bottom member, and said bottom horizontal member of said first bottom member, wherein a user may unlock said locking mechanisms from their respective notches by pulling on said release cord.

19. The garment stretching device of claim 1, wherein the only adjustable interlocking frame members that said garment stretching device consists of are top T-member, top L-member, first bottom member, and second bottom member.

20. The garment stretching device claim 1, wherein at least one of said horizontal member of said top T-member, said top horizontal member of said first bottom member, said vertical member of said first bottom member, said top horizontal member of said second bottom member, and said vertical member of said second bottom member comprise a textured outer surface.

* * * * *